United States Patent [19]

Koboshi et al.

[11] Patent Number: 4,939,073

[45] Date of Patent: Jul. 3, 1990

[54] STABLIZED METHOD OF LIGHT SENSITIVE SILVER HALIDE COLOR PHOTOGRAPHIC MATERIAL

[75] Inventors: Shigeharu Koboshi, Sagamihara; Masayuki Kurematsu, Hachioji, both of Japan

[73] Assignee: Konishiroku Photo Industry Co., Ltd., Tokyo, Japan

[21] Appl. No.: 418,950

[22] Filed: Oct. 6, 1989

Related U.S. Application Data

[63] Continuation of Ser. No. 150,455, Jan. 28, 1988, abandoned, which is a continuation of Ser. No. 828,609, Feb. 12, 1986, abandoned, which is a continuation of Ser. No. 643,766, Aug. 24, 1984, abandoned, which is a continuation of Ser. No. 530,001, Sep. 7, 1983, abandoned, which is a continuation of Ser. No. 399,219, Jul. 19, 1982, abandoned.

[30] Foreign Application Priority Data

Jul. 21, 1981 [JP] Japan ..... 56-112939

[51] Int. Cl.[5] ..... G03C 7/40; G03C 5/26

[52] U.S. Cl. ..... 430/372; 430/393; 430/421; 430/428; 430/429

[58] Field of Search ..... 430/372, 393, 421, 428, 430/429

[56] References Cited

U.S. PATENT DOCUMENTS

| | | | |
|---|---|---|---|
| 2,788,274 | 4/1957 | Ranger | 430/429 |
| 3,157,504 | 11/1964 | Bard | 430/372 |
| 3,591,380 | 7/1971 | Ohkubo et al. . | |
| 3,666,468 | 5/1972 | Amano et al. | 430/372 |
| 3,997,348 | 12/1976 | Shimamura et al. | 430/372 |
| 4,040,837 | 8/1977 | Sakamoto et al. . | |
| 4,083,721 | 4/1978 | Inouye et al. . | |
| 4,229,521 | 10/1980 | Frank et al. | 430/372 |
| 4,265,431 | 5/1981 | Falomo . | |
| 4,297,437 | 10/1981 | Kaneko et al. . | |
| 4,301,236 | 11/1981 | Idota et al. . | |
| 4,336,324 | 6/1982 | Koboshi et al. | 430/372 |
| 4,681,835 | 7/1987 | Ishikawa et al. | 430/386 |

FOREIGN PATENT DOCUMENTS

| | | |
|---|---|---|
| 2212905 | 9/1973 | Fed. Rep. of Germany . |
| 2433695 | 1/1975 | Fed. Rep. of Germany . |
| 2528139 | 1/1976 | Fed. Rep. of Germany . |
| 1466285 | 3/1977 | United Kingdom . |
| 1495231 | 12/1977 | United Kingdom . |

OTHER PUBLICATIONS

"Using Kodak Ektaprint 2 Chemicals", Eastman Kodak Co., 356-1-80-C-New, 1980.

"Photographic Processing Chemistry", L. F. A. Mason, the Focal Press.

"The Theory of the Photographic Process", Fourth Edition, Macmillan Publishing Co., Inc.

European Patent Office Search Report, EP 82303842.7, dated Oct. 27, 1982.

"Water Flow Rates in Immersion-Washing of Motion-Picture Film", Samuel R. Goldwasser, Journal of the SMPTE, vol. 64, May 1955.

*Primary Examiner*—Richard L. Schilling

*Assistant Examiner*—Janet C. Baxter

*Attorney, Agent, or Firm*—Finnegan, Henderson, Farabow, Garrett and Dunner

[57] ABSTRACT

A method of stabilizing a light-sensitive silver halide color photographic material. A developed silver halide color photographic material is contacted, subsequent to a processing step in a bleach-fixing bath or a fixing bath and substantially accompanied by no washing step, at the last stage of color processing with a dye stabilizing solution adjusted to a pH value between 3.0 and 9.0 and containing a soluble complex salt of an iron ion obtained by reacting an iron ion with a compound selected from the group consisting of The soluble complex salt of an iron ion is present in the dye stabilizing solution at a concentration of at least $1\times10^{-4}$ mol/l.

41 Claims, No Drawings

STABLIZED METHOD OF LIGHT SENSITIVE SILVER HALIDE COLOR PHOTOGRAPHIC MATERIAL

This application is a continuation, of application Ser. No. 150,455 filed January 28, 1988, now abandoned, which is a continuation of Ser. No. 828,609, filed February 12, 1986, now abandoned, which is a continuation of Ser. No. 643,766, filed August 24, 1984, now abandoned, which is a continuation of Ser. No. 530,001, filed September 7, 1983, now abandoned, which is a continuation of Ser. No. 399,219, filed July 19, 1982, now abandoned.

The present invention relates to a stabilizing method of dye image formed in the light-sensitive silver halide color photographic material.

It is well known that the light-sensitive silver halide color photographic material produces azomethine and indoaniline dyes by color development to form the color image.

It is also well known that these dyes discolor under ultraviolet or visible rays of light. Further, their discoloration also occurs even when they are kept in the dark. Particularly, this discoloration is accelerated at high temperature and humidity. This phenomenon of discoloration of developed color image is an important weak point of color photography and an improvement at this point has been strongly wished for.

Various preventive measures have hitherto been known to prevent the discoloration of developed color image in the silver halide color photographic material at the dark or at the light. For example, U.S. Pat. No. 2,788,274 disclosed a process in a zinc salt solution; U.S. Pat. No. 2,913,338 a process making use of calcium, magnesium or cadmium salt; and British Patent Nos. 909,824 and 1,001,446 a process to treat in a solution containing a monosaccharide, disaccharide or hexitol and a process in a solution containing formaldehyde and polycarboxylic acid, respectively.

However, some of these preventive measures give only a slight effect and the other, though effective in preventing the discoloration, many of compounds used in these methods soften the gelatin film to remarkably weaken its mechanical strength. To prevent softening of the gelatin layer, therefore, formaldehyde is used in some cases notwithstanding this compound is harmful in practical application having a demerit to cause soiling of white border.

Accordingly, to prevent the discoloration of dye picture, chemicals with which the photographic material has been loaded in processing baths must be removed in a washing step of long time with use of a water volume as large as possible. For faster processing and labor saving, therefore, the stabilizing process of a minor or inferior effect as mentioned above is omitted in some cases. Further, for the same purposes and also for the alleviation of environmental pollution and reduction of processing cost, it is a general practice to perform processes in individual processing solutions at hot temperature, shorten the washing time, and/or use a reduced volume of water for washing, which would further make the stabilization of dye image less effective.

On the one hand, a stabilizing process that includes no washing step is also disclosed, for example, by U.S. Pat. No. 3,335,004. This is a silver stabilizing process making use of a thiocyanate salt whose stabilizing bath contains sulfite salts abundantly, so image dyes are readily reduced to their leuco form influencing the color photographic image significantly for its deterioration. Further, at such a low pH as applies to the above stabilizing bath, there is a danger of generating sulfurous acid gas. Thus, the process is never satisfactory.

In this manner, the conventional stabilizing process of color image fails in achieving the stabilization of photographic image for long period of time while simultaneously speeding up the process time, saving labor, alleviating environmental pollution and reducing the volume of washing water.

After investigation of various measures to prevent the discoloration of developed color image in the dark or in the light, the present authors have completed the present invention.

Accordingly, an object of the present invention is to provide a stabilizing process of dye image that can not only remarkably suppress the discoloration of developed color image without softening the gelatin film but reduce the volume of washing water or even save the washing step itself.

The above object of the invention can be achieved by such a stabilizing method of the dye image in the light-sensitive silver halide color photographic material comprising the step of stabilizing a developed silver halide color photographic material, in a dye stabilizing solution comprising a soluble iron salt (a water soluble iron salt) at a concentration of at least $1\times10^{-4}$ mol/l and adjusted to a pH value between 3.0 and 9.0, at the last stage of color processing of said photographic material.

According to a preferable embodiment of the present invention, the stabilizing process of the invention is performed following a bleach-fixing bath or a fixing bath and substantially accompanied by no washing step.

Other and further objects, features and advantages of the invention will appear more fully from the following description.

The soluble iron salt to be comprised in stabilizing solution of present invention are various complex salts of divalent or trivalent iron ion. Compound supplying these iron ion are, for example, ferric chloride, ferric sulfate, ferric nitrate, ferrous chloride, ferrous sulfate, and ferrous nitrate, carboxylic acid iron salts including ferric acetate and ferric citrate, and various iron complex salts. Examples of the compounds that can react with these iron ion to form complex salts are expressed by the following general formulas [I] through [XI].

$$M_mP_mO_{3m} \qquad \text{Formula [I]}$$

$$M_{n+2}P_nO_{3n+1} \qquad \text{Formula [II]}$$

In the formulas [I] [II],

M: Hydrogen, alkali metal, or ammonium;

m: Integer from 3 to 6 n: Integer from 2 to 20

$$B-A_1-Z-A_2-C \qquad \text{Formula [III]}$$

$$\begin{array}{ccccc} D-A_3 & & & & A_5-F \\ & \diagdown & & \diagup & \\ & & N-Z-N & & \\ & \diagup & & \diagdown & \\ E-A_4 & & & & A_6-G \end{array} \qquad \text{Formula [IV]}$$

In the formulas [III] and [IV], $A_1$ through $A_6$ represent substituted or unsubstituted alkyl groups, Z an alkylene group, a cyclo alkylene group, a phenylene group, —R—O—R, —ROROR— (R=alkyl group), or >N—$A_7$ [$A_7$=hydrogen, hydrocarbon (preferably $C_1$-$C_{12}$ alkyl group), lower aliphatic carbonic acid, lower alcohol (preferably $C_1$-$C_4$ alcohol)], and B, C, D, E, F, and G an —OH group, —COOM group, or —$PO_3M_2$ (M=hydrogen, alkali metal, or ammonium).

Formula [V]

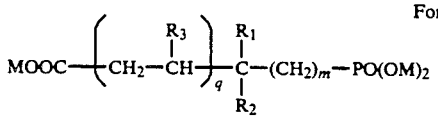

where $R_1$: —COOM, —$PO(OM)_2$;

$R_2$: Hydrogen, alkyl group (preferably $C_1$ to $C_4$ alkyl group), —$(CH_2)_n$COOM, or phenyl group;

$R_3$: Hydrogen, —COOM;

M: Hydrogen, alkali metal, or ammonium;

m: Integer 0 or 1; and n: Integer from 1 to 4 q: Integer 0 or 1

$R_4N(CH_2PO_3M_2)_2$ Formula [VI]

where $R_4$: Lower alkyl group, aryl group, aralkyl group, or nitrogen-containing 6-membered heterocyclic group [possible substituent: —OH, —$OR_5$ ($R_5$=alkyl group of $C_1$ to $C_4$), —$PO_3M_2$, —$CH_2PO_3M_2$, —$N(CH_2PO_3M_2)_2$, —$COOM_2$, and/or —$N(CH_2COOM)_2$]; and M: Hydrogen, alkali metal or ammonium Formula [VII]

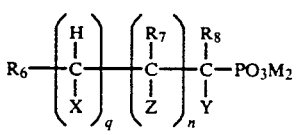

where $R_6$, $R_7$, $R_8$: Hydrogen, lower alkyl group, —OH, a hydroxyalkyl group, $PO_3M_2$ or —$NJ_2$ (J=H, OH, lower (preferably $C_1$-$C_4$) alkyl group, or —$C_2H_4OH$, —$PO_3M_2$);

X, Y, and Z: —OH, —COOM, —$PO_3M_2$, or H;

M: Hydrogen, alkali metal, or ammonium; and n, q: Integer 0 or 1

Formula [VIII]

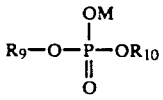

where

M, $R_9$, $R_{10}$: Hydrogen, alkali metal, ammonium, alkyl group of $C_1$ to $C_{12}$, alkenyl group, or alicyclic group Formula [IX]

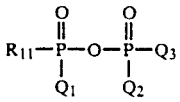

where $R_{11}$: Alkyl group preferably $C_1$ to $C_{12}$, alkoxy group preferably $C_1$ to $C_{12}$, monoalkylamino group preferably $C_1$ to $C_{12}$, dialkylamino group preferably $C_2$ to $C_{12}$, amino group, aryloxy group preferably $C_1$ to $C_{24}$, allylamino group or amyloxy group preferably $C_6$ to $C_{24}$; and $Q_1$ through $Q_3$: —OH, alkoxy group preferably $C_1$ to $C_{24}$, aralkyloxy group, aryloxy group, —$OM_3$ ($M_3$=alkali metal or ammonium), amino group, morpholino group, cyclic amino group, alkylamino group, dialkylamino group, allylamino group, or alkyloxy group Beside compounds as expressed by the general formulas [I] through [XI], citric acid, glycine, etc. may be cited though the former compounds will exert a superior effect.

Specific examples of the compounds as expressed by the formulas [I] through [XI] are:

$Na_4P_4O_{12}$ (1)

$Na_3P_3O_9$ (2)

$H_4P_2O_7$ (3)

$H_5P_3O_{10}$ (4)

$Na_6P_4O_{13}$ (5)

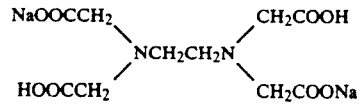

(6)

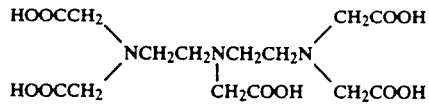

(7)

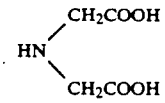

(8)

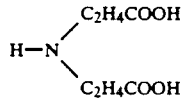

(9)

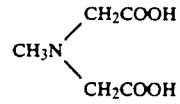

(10)

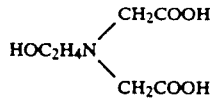

(11)

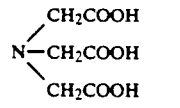

(12)

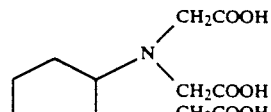

(13)

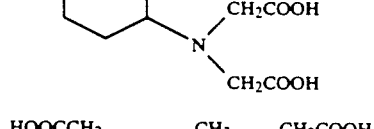

(14)

-continued
$(HOC_2H_4)_2NCH_2COOH$ (15)
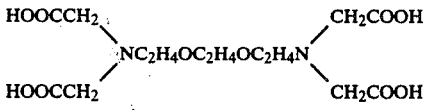
(16)
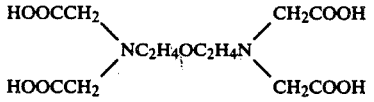
(17)
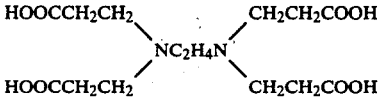
(18)
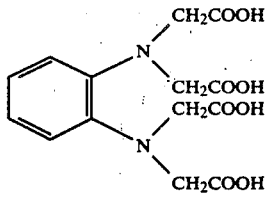
(19)
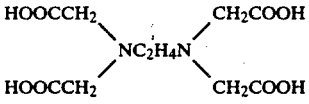
(20)
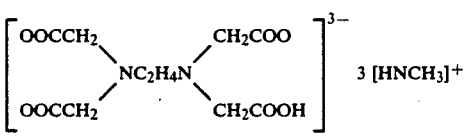
(21)
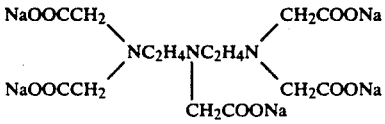
(22)
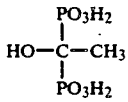
(23)
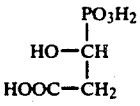
(24)
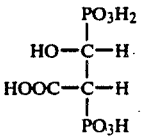
(25)
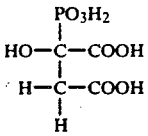
(26)
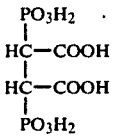
(27)
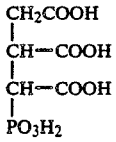
(28)
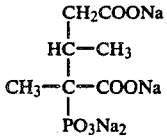
(29)
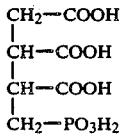
(30)
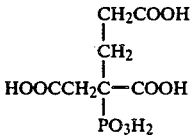
(31)
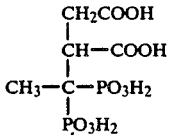
(32)
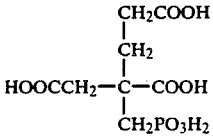
(33)
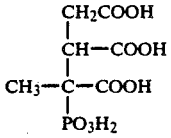
(34)
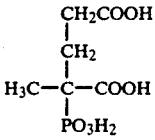
(35)
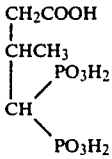
(36)
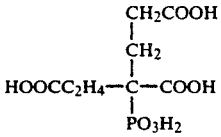
(37)

-continued
(38)
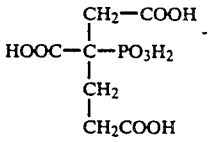
(39)
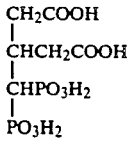
(40)
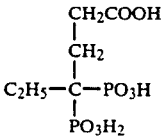
(41)
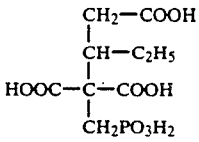
(42)
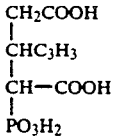
(43)
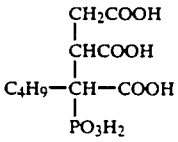
(44)
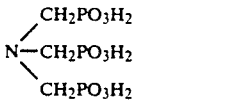
(45)
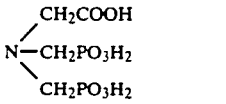
(46)
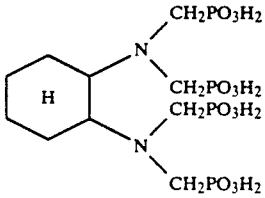
(47)
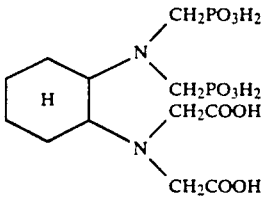
-continued
(48)
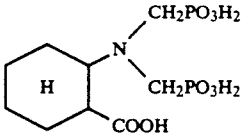
(49)
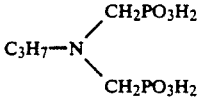
(50)
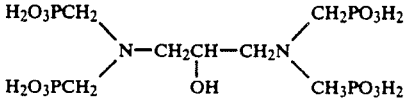
(51)
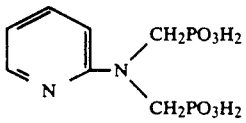
(52)
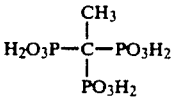
(53)
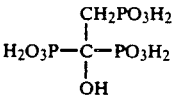
(54)
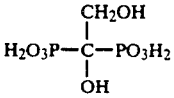
(55)
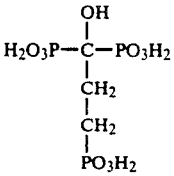
(56)
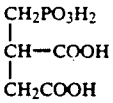
(57)
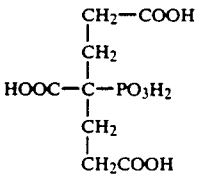
(58)
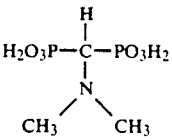
(59)
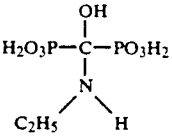

-continued (60)

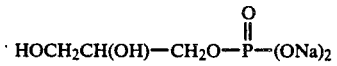

(61)

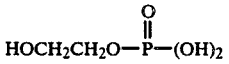

(62)

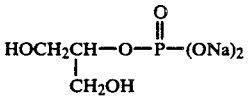

(63)

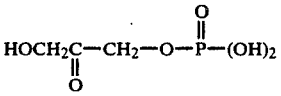

(64)

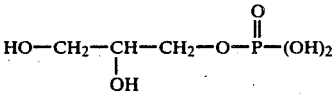

(65)

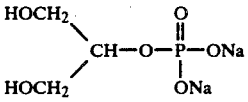

(66)

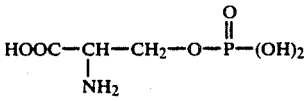

(67)

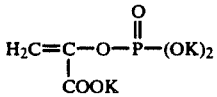

(68)

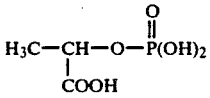

(69)

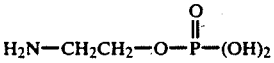

(70)

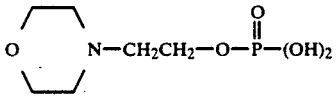

(71)

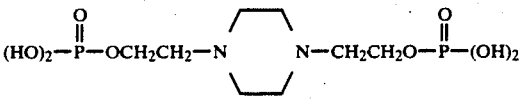

(72)

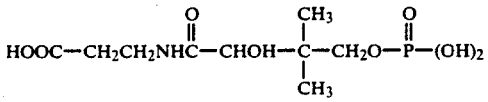

(73)

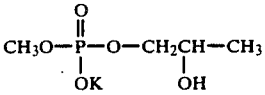

(74)

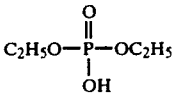

-continued (75)

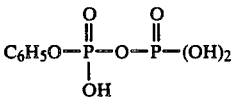

(76)

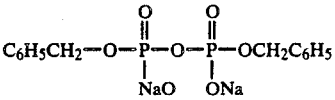

(77)

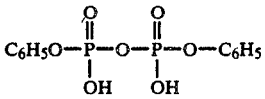

(78)

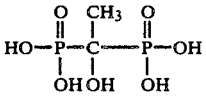

(79)

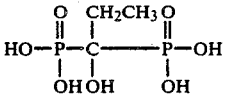

(80)

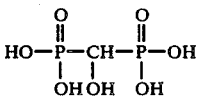

(81)

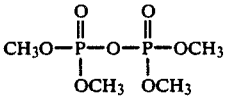

(82)

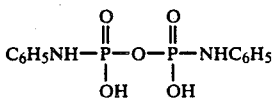

(83)

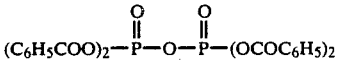

(84)

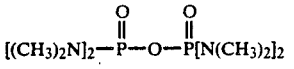

The soluble iron salt used in the present invention can be added to the stabilizing bath at a concentration between $1\times10^{-4}$ and $1\times10^{-1}$ mol/l, and preferably between $4\times10^{-4}$ and $1\times10^{-2}$ mol/l. For a continuous stabilizing process whose stabilizing bath comprises a number of successive tanks for treatment in a counter-current system with replenishing solution added to the last tank, the desirable amount of the above soluble iron salt for addition is determined with reference to the concentration of the last tank.

The stabilizing solution (or stabilizing bath) of the present invention is set to a pH between 3.0 and 9.0. At pH below 3.0 and also above 9.0, the effect of the soluble iron salt in preventing the discoloration of dyes will be reduced. In the present invention, therefore, the pH is preferably adjusted between 4.5 and 8.5 and more preferably between 6.0 and 8.0. To the stabilizing solution of the present invention are preferably added buffer agents for the buffering action. For such buffer agents, acetic acid, sodium acetate, boric acid, phosphoric acid, sodium hydroxide, etc. are preferably used, though such iron complex forming agents as mentioned above may be used in excess of iron ions for buffering action.

According to the present invention, the discoloration of the color picture can be avoided without softening the gelatin film. Further, in the present invention, the treatment in a stabilizing bath containing iron ions improves the stability of dye picture substantially even when a foreign chemical or chemicals are retained in traces in the photographic material. As a result, the washing time is shortened and even the entire washing step can be saved. In the prior art, a compound such as ethylenediaminetetracetic acid ferric complex salt that is used as a bleaching agent in color processing is thoroughly washed out in the washing step but an investigation made by the present authors resulted in a rather unexpected finding that presence of soluble iron ions in a proper concentration range as in this case contributes by far to the stabilization of dye picture.

In color processing, if a processing bath loaded with an organic acid ferric complex salt is used for processing, the stabilizing process is a step that follows such processing bath, so the soluble iron salt of the present invention is automatically brought in for replenishment with the photographic material, which allows to perform the stabilizing process without loading the replenishing stabilizing solution with any soluble iron salt. Further, at the same time, the conventional washing step can be saved. Naturally, to maintain the concentration of soluble iron salt in a range as specified herein, both the volume of solution brought in with the photographic material from the processing bath loaded with the organic acid ferric complex salt and the volume of replenishing stabilizing solution must be controlled. It was found that under presence of a soluble iron salt of the present invention other chemical ingredients, for example, thiosulfate and sulfite salts, that are dissolved in the processing solution loaded with an organic acid ferric complex salt stay a neutral factor in the discoloration of dye picture as far as their concentration is below a certain critical level, resulting in higher stability of the dye picture. To reduce the concentration of these chemical ingredients down to a desirable level, it is preferable to perform the stabilization in a stabilizing bath comprising a plurality of tanks while replenishing solution in a countercurrent system.

With the stabilizing bath of the present invention, it is important to perform the stabilization at the final stage of color processing, and the stabilizing process is preferably directly followed by the drying step, though it may be followed instead by a rinsing or washing step to remove superfluous chemical ingredients from the photographic material in such a degree that the soluble iron salt is not fully washed out therefrom, or by a step for coating with another processing solution containing an oxidizing agent, for example, hydrogen peroxide or persulfate salt, or dipping in a bath of such solution. Further, if a bleaching solution or bleach-fixing solution containing an organic acid ferric complex salt as a bleaching agent is used, the processing with such solution is preferably directly followed by the stabilization process, but insertion of a step of rinsing or washing to such a degree that the organic acid ferric complex salt may be brought in the stabilizing bath with the photographic material in an amount enough to maintain its concentration in the bath in a range as specified herein.

The stabilizing process of the present invention is performed at the final stage of the color processing. The stabilizing bath may comprise a single tank. For a reason as mentioned above, however, in case the processing in the bleach-fixing bath or fixing bath is directly followed by the stabilizing process, the stabilizing bath of the present invention preferably comprises a plurality of tanks for the multi-bath process. Further, the number of tanks used to achieve the aforementioned object of the invention is closely dependent on the relation between the amount brought in with the photographic material from the processing bath containing the organic acid ferric complex salt and the volume of replenishing solution added. Namely, the smaller the ratio of the volume of replenishing solution added to the amount brought in, the larger the number of tanks required, and vice versa.

Though, generally, the number of tanks also depends on the concentration of the bath containing the organic acid ferric complex salt, in case the volume of replenishing solution used is about three to five times as large as the volume brought in, two to eight tanks are preferably used for the stabilization and, for example, in case the above volume ratio is fifty times, preferably two to four tanks are used for the stabilization to achieve the intended object.

For the stabilizing bath of the present invention, a buffered solution whose pH is adjusted between 3.0 and 9.0 is applicable, for which various buffer agents can be used. Specific examples of such buffer agents are borate, metaborate, borax, monocarboxylate, dicarboxylate, polycarboxylate, hydroxycarboxylate, amino acid, aminocarboxylate, monobasic, dibasic and tribasic phosphate, sodium hydroxide, and potassium hydroxide. Further, beside the soluble iron salt and iron complex salt, various chelating agents can likewise be added. Examples of such chelating agents are aminopolycarboxylate, aminopolyphosphonic acid, phosphonocarboxylic acid, alkylidenediphosphonic acid, polyphosphate, pyrophosphoric acid, metaphosphoric acid, and gluconate.

Beside, there are commonly known additives to the stabilizing bath, for example, fluorescent whitening dye, surfactant, bactericide, antiseptic, organic sulfur compound, onium salt, formalin, hardening agent such as aluminum or chromium, and various metal salts. These compounds can be added in any combination and quantities as far as the pH of stabilizing bath can be maintained in the range as specified herein, the stability of the photographic picture during storage is not affected adversely, and there appears no sign of precipitation in the bath.

Beside the soluble iron salt, compounds preferably added to the stabilizing bath of the present invention are buffer agents such as acetic acid and sodium acetate, bactriocides such as 5-chloro-2-methyl-4-isothiazolin-3-on, 1-2-benzisothiazolin-3-on and thiabenzazole, trace of formaldehyde, hardening agents such as aluminium salt and magnesium salt, fluorescent whitening dye, etc. However, since the processing method of the present invention can achieve efficient stabilization of the dye picture and save the washing step, the above additive compounds are preferably added at a more dilute concentration from the viewpoint of avoiding the environmental pollution and reducing the processing cost as far as they are added enough to endow the solution with a satisfactory buffering capacity.

The temperature for the stabilization is set between 15° and 60° C., and preferably between 20° and 45° C. On the other hand, the stabilization time is preferably set short from the viewpoint of quick processing, which is normally between 20 sec and 10 min, and most preferably between 1 and 5 min. In case of multi-tank stabilization system, preferably, the earlier the stage of a tank, the shorter the treatment time therein and vice versa. Specifically, it is preferable to treat in successive tanks for the treatment time at a tank increased 20 to 50% as compared to the previous tank. According to the present invention, the stabilization process need not be followed by any washing step, though a very short time of rinsing, surface washing, etc. in a small volume of water can be arbitrarily performed as necessary.

In this way, the processing method of the present invention can also be applied to the color paper, color reversal paper, color positive film, color negative film, color reversal film, color X-ray film, etc.

In case the stabilizing bath of the present invention contains soluble silver salts, silver can be recovered from the bath by the technique of ion exchange, metal substitution, electrolysis, silver sulfide precipitation, etc.

To further illustrate the invention, and not by way of limitation, the following examples are given.

EXAMPLE 1

A sample of Sakura Color Paper was exposed to rays of light of graded intensity pattern. After color development, bleaching and fixing, and washing, the sample was cut in seven pieces. They were dipped 1 min in a bath of individual formulations (I) through (VII) as given in Table 1 at 33° C. and then dried to provide test samples.

TABLE 1

| | I | II | III | IV | V | VI | VII |
|---|---|---|---|---|---|---|---|
| Folmaldehyde [ml] | — | 0.1 | 0.1 | 0.1 | 0.1 | 0.1 | 0.1 |
| 1-hydroxy-ethylidene-1,1-diphosphonic acid [g] | — | 0.5 | 0.5 | 0.5 | 0.5 | 0.5 | 0.5 |
| 90% acetic acid [ml] | 1 | 1 | 1 | 1 | 1 | 1 | 1 |
| Fluorescent whitening dye [g] (Note) | — | 1 | 1 | 1 | 1 | 1 | 1 |
| Ethylenediamine-tetraacetic acid ferric sodium salt [g] | — | 0 | 0.05 | 0.5 | 1.0 | 10 | 100 |
| 1,2-benzisothi-azolin-3-on [mg] | — | 50 | 50 | 50 | 50 | 50 | 50 |
| pH as adjusted with sodium hydroxide | 6.95 | 6.95 | 6.95 | 6.95 | 6.95 | 6.95 | 6.95 |

Note:
For the fluorescent whitening dye, Keicol-PK-Conc from Shinniso Kako Co., Ltd. was used.

With the above samples, the maximum density of blue, green, and red color was measured. After they were kept for sixty days in a thermo-hygrostat set to 80° C. and 80% RH, the same parameters were measured to estimate the percentage density drop for each color. The results are given in Table 2.

TABLE 2

| Sample No. (stabilizing solution) | Density dropping rate (%) | | |
|---|---|---|---|
| | Blue | Green | Red |
| (I) Control | 36 | 41 | 66 |
| (II) Control | 34 | 40 | 68 |
| (III) Present invention | 23 | 31 | 29 |
| (IV) Present invention | 20 | 28 | 19 |
| (V) Present invention | 21 | 21 | 22 |
| (VI) Present invention | 26 | 24 | 31 |

TABLE 2-continued

| Sample No. (stabilizing solution) | Density dropping rate (%) | | |
|---|---|---|---|
| | Blue | Green | Red |
| (VII) Control | 29 | 26 | 66 |

It is clearly seen from Table 2 that the samples (III) through (VI) that were stabilized according to the present invention exhibited appreciable suppression of dye discoloration, and particularly in red color, proving the remarkable effect of the invention in preventing discoloration. Further, with these samples, the discoloration was small for each of the blue, green and red density and balanced between colors, so there was no significant color unbalance and as a result, the apparent discoloration as determined by eyes was much smaller as compared to the percentage discoloration as estimated by the density measurement.

EXAMPLE 2

The same experimental method as in Example 1 was used. The sample after washing was cut into six pieces and they were dipped 1 min in a bath of individual formulations (I) through (VI) as given in Table 3 at 33° C. and then dried to provide test samples.

TABLE 3

| | I | II | III | IV | V | VI |
|---|---|---|---|---|---|---|
| 35% formaldehyde [ml] | — | 0.3 | 0.3 | 0.3 | 0.3 | 0.3 |
| 1-hydroxyethylidene-1,1-diphosphonic acid [g] | 20 | 20 | 20 | 20 | 20 | 20 |
| Glacial acetic acid [ml] | 1 | 1 | 1 | 1 | 1 | 1 |
| Iron chloride, hexahydrate [g] | — | 1.5 | 1.5 | 1.5 | 1.5 | 1.5 |
| 5-chloro-2-methyl-4-isothiazolin-3-on [g] | 0.2 | 0.2 | 0.2 | 0.2 | 0.2 | 0.2 |
| pH as adjusted with sodium hydroxide | 7.0 | 2.0 | 4.0 | 6.0 | 8.0 | 10.0 |

With the above samples, the red mid-density was measured. After they were kept for sixty days in a thermo-hygrostat set to 80° C. and 80% RH, the measurements were repeated for comparison. For the red mid-density, the percentage density drop was estimated. The results are given in Table 4.

TABLE 4

| Sample No. (stabilizing solution No. used) | pH of stabilizing solution | % density drop for red mid-density |
|---|---|---|
| (I) Control | 7.0 | 62 |
| (II) Control | 2.0 | 89 |
| (III) Present invention | 4.0 | 24 |
| (IV) Present invention | 6.0 | 27 |
| (V) Present invention | 8.0 | 28 |
| (VI) Control | 10.0 | 57 |

It is clearly seen from Table 4 that a pH setting lower than the range specified herein leads to an unfavorable result that the red mid-density discolors more during storage. Further, a pH higher than the same range also reduces the red mid-density more. On the other hand, with the pH of stabilizing solution set in the preferable range of invention, the red mid-density was kept at a desirable level to suppress discoloration during storage. Beside, the lowest density of blue color was measured with the test samples obtained. For the lowest blue density, it was thus found that even in the preferable pH range, the higher the pH value, the more favorable the result.

EXAMPLE 3

After picture printing, a roll of Sakura color paper (manufacturer: Konishiroku Photo Industry Co., Ltd.) was processed by an automatic developing machine to perform color processing with continuous replenishment. The processes and the formulation of processing solutions used were as follows:

| Standard processes: | | |
|---|---|---|
| 1. Color development | 33° C. | 3' 30" |
| 2. Bleach-fixing | 33° C. | 1' 30" |
| 3. Stabilization | 25 to 30° C. | 3' |
| 4. Drying | 75 to 80° C. | Approx. 2' |

| Formulation of processing solutions: | |
|---|---|
| [Color development tank's solution] | |
| Benzyl alcohol | 15 ml |
| Ethylene glycol | 15 ml |
| Potassium sulfite | 2.0 g |
| Potassium bromide | 0.7 g |
| Sodium chloride | 0.2 g |
| Potassium carbonate | 30.0 g |
| Hydroxylamine sulfate | 3.0 g |
| Polyphosphoric acid (TPPS) | 2.5 g |
| 3-methyl-4-amino-N-ethyl-N-(β-methanesulfonamido-ethyl)-aniline sulfate | 5.5 g |
| Fluorescent whitening dye (4,4'-diaminostylbenedi-sulfonic acid derivative) | 1.0 g |
| Potassium hydroxide | 2.0 g |
| Adding water | |
| | 1 liter |
| [Color development replenishing solution] | |
| Benzyl alcohol | 20 ml |
| Ethylene glycol | 20 ml |
| Potassium sulfite | 3.0 g |
| Potassium carbonate | 30.0 g |
| Hydroxylamine sulfate | 4.0 g |
| Polyphosphoric acid (TPPS) | 3.0 g |
| 3-methyl-4-amino-N-ethyl-N-(β-methanesulfonamido-ethyl)-aniline sulfate | 7.0 g |
| Fluorescent whitening dye (4,4'-diaminostylbenedisulfonic acid derivative) | 1.5 g |
| Potassium hydroxide | 3.0 g |
| Adding water | |
| | 1 liter |
| [Bleach-fix tank's solution] | |
| Ethylenediaminetetraacetic acid ferric ammonium di-hydrate salt | 60 g |
| Ethylenediaminetetraacetic acid | 3 g |
| Ammonium thiosulfate (70% solution) | 100 ml |
| Ammonium sulfite (40% solution) | 27.5 ml |
| pH adjust to 7.1 with potassium carbonate or glacial acetic acid | |
| Adding water | |
| | 1 liter |
| [Bleach-fix replenishing solution A] | |
| Ethylenediaminetetraacetic acid ferric ammonium di-hydrate salt | 260 g |
| Potassium carbonate | 42 g |
| Adding water | |
| | 1 liter |

Note: pH of this solution was 6.7 ± 0.1.

-continued

| [Bleach-fix replenishing solution B] | |
|---|---|
| Ammonium thiosulfate (70% solution) | 500 ml |
| Ammonium sulfite (40% solution) | 250 ml |
| Ethylenediaminetetraacetic acid | 17 g |
| Glacial acetic acid | 85 ml |
| Adding water | |
| | 1 liter |

Note: pH of this solution was 4.6 ± 0.1.

The automatic developing machine was filled with the color development tank's solution and bleach-fix tank's solution as formulated above, and a stabilizing solution as formulated below. While processing the color paper, the above color development replenishing solution, bleach-fix replenishing solutions A and B, and stabilizing replenishing solution were added at intervals of 3 min using a measuring cup to conduct a running test. The color development tank was replenished at a rate of 324 ml of replenishing solution/$m^2$ of color paper, while the bleach-fix tank at a rate of 25 ml of each replenishing solution/$m^2$ of color paper.

For stabilization, the stabilizing bath of the automatic developing machine was modified so it might comprise a tank or three or six tanks for a continuous process. When the stabilizing bath of an automatic developing machine comprised a plurality of tanks, the successive tanks were named the first through third tanks or the first through sixth tanks in the flowing direction of the photographic material and the multi-tank countercurrent system in which the loss of solution was made up for at the last tank with the overflow from one tank added to another tank at a step earlier was used.

The stabilization in a solution as formulated below was performed after the continuous processing was continued until the bleach-fix replenishing solutions A and B were added in the sum of their total volumes three times as large as the capacity of tank of bleach-fix bath.

The first tank of the stabilizing bath was checked for any sign of precipitation, while the red mid-density (D=1.5) was measured with the test samples obtained by the running processing. The samples were left to stand at 80° C. and 80 RH % for sixty days and the measurements for the red mid-density were repeated.

Table 5 shows the results.

It is noted that 50 ml of bleach-fix solution was brought into the stabilizing bath with each square meter of color paper.

| Stabilizing solution (replenisher) | |
|---|---|
| Glacial acetic acid | 2 ml |
| Formalin | 0.5 ml |
| Thiabenzazole | 0.05 g |
| 1-hydroxyethylidene-1,1-diphosphonic acid | 20 g |
| Potassium alum | 20 g |
| Ethylenediaminetetraacetic acid ferric sodium salt | 1.2 g |
| Adding water and, pH adjusted to 6.5 with sodium hydroxide | |
| | 1 liter |

Note:
Same fluorescent whitening dye as in Example 1 was used.

TABLE 5

| Sample No. | Tanks of stabilizing bath | Replenishment of stabilizing bath (ml/m²) | Precipitation (1st tank) | Dropping rate of red mid-density (%) |
|---|---|---|---|---|
| 1. Control (washing) | 3 | 10,000 (tap water) | Detected | 86 |
| 2. Stabilized by present invention | 1 | 500 | None | 62 |
| 3. Stabilized by present invention | 1 | 2,000 | " | 51 |
| 4. Stabilized by present invention | 1 | 5,000 | " | 39 |
| 5. Stabilized by present invention | 2 | 500 | " | 38 |
| 6. Stabilized by present invention | 2 | 2,000 | " | 33 |
| 7. Stabilized by present invention | 3 | 500 | " | 27 |
| 8. Stabilized by present invention | 3 | 2,000 | " | 24 |
| 9. Stabilized by present invention | 6 | 500 | " | 21 |
| 10. Stabilized by present invention | 6 | 2,000 | " | 22 |

As also evidenced by the above table, in washing of the control sample (1), there was detected slight precipitation in the first tank with appearance of algae at the tank walls in spite of a very large volume of water used for replenishment, resulting in significant contamination of color paper in some cases. Further, in the sample storage test, a large drop of red mid-density was detected in this case. By contrast, with the samples (2) through (9) that were stabilized according to the present invention, there was no precipitation in the stabilizing tank and the red mid-density showed a smaller drop in the storage test. Even in the stabilization of the present invention, however, if the bleach-fixing process was directly followed by the stabilizing process and if the volume of replenishing solution used was less than hundred times the volume of bleach-fixing solution brought in with the photographic material, the effect in preventing the red discoloration was limited, in case of a single tank stabilizing bath, to some degree, showing a considerable decline probably because there was not enough dilution of the ingredients other than the ferric complex salt brought in from the bleach-fix solution. Namely, it was found that in case the method of stabilizing the dye picture in the stabilizing solution of the present invention is used and the fixing or bleach-fixing process is directly followed by the stabilizing process, a more remarkable effect of the invention in preventing the discoloration of dye picture can be achieved by using a stabilizing bath comprising a plurality of tanks and by making the solution overflowing one tank to next to provide a countercurrent system with the loss of solution made up for at the tank of last stage in the flow of photosensitive material.

Beside the present example, a similar experiment was made with use of a replenishing stabilizing solution of the same formulation except that the ethylenediaminetetraacetic acid ferric complex salt was removed therefrom, when iron ions were supplied with the bleach-fix solution that was brought in to achieve almost an equivalent effect to the present example. It is noted that for the three tank bath used for the stabilization of samples (7) and (8) of present example, the dip time was set to 20, 40 sec and 2 min for the first, second and third tank, respectively, while for the six tank bath used for the stabilization of samples (9) and (10), the time was set to 10 sec for the first two tanks, and 20, 30, 50 sec and 1 min for the third, fourth, fifth and sixth tank, respectively.

What is claimed is:

1. A method of stabilizing a light-sensitive silver halide color photographic material comprising the step of contacting, subsequent to a processing step in a bleach-fixing bath or a fixing bath and substantially accompanied by no washing step, a developed silver halide color photographic material at the last stage of color processing of said photographic material with a dye stabilizing solution adjusted to a pH value between about 3 and about 9 and comprising a soluble complex salt of an iron ion obtained by reacting an iron ion with a compound selected from the group consisting of

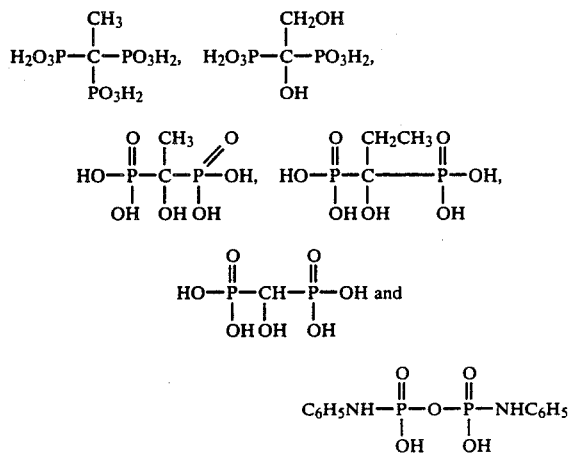

said soluble complex salt of an iron ion being present in a concentration of at least about $1\times10^{-4}$ mol/l.

2. A method according to claim 1, wherein the complex salt of an iron ion is present at a concentration of about $1\times10^{-4}$ to about $1\times10^{-1}$ mol/l.

3. A method according to claim 2, wherein the complex salt of an iron ion is present at a concentration of about $4\times10^{-4}$ to about $1\times10^{-2}$ mol/l.

4. A method of stabilizing a light-sensitive silver halide color photographic material, comprising the step of contacting in multiple stabilizing tanks subsequent to a processing step in a bleach-fixing bath or a fixing bath, a developed silver halide color photographic material at the last stage of color processing of said photographic material with a dye stabilizing solution adjusted to a pH value between about 3 and about 9 and comprising a soluble complex salt of an iron ion, said soluble complex salt being present in the last of said multiple tanks in a stabilizing concentration of at least $1\times10^{-4}$ mol/l.

5. A method according to claim 4, wherein the soluble iron salt is a complex salt of an iron ion and a compound represented by Formula (I) or (II):

$$M_mP_mO_{3m} \qquad \text{Formula (I)}$$

$$M_{(n+2)}P_nO_{(3n+1)} \qquad \text{Formula (II)}$$

wherein

M represents a hydrogen atom, an alkali metal, or an ammonium cation;

m represents an integer from 3 to 6; and n represents an integer from 2 to 20.

6. A method according to claim 4, wherein the soluble iron salt is a complex salt of an iron ion and a compound represented by Formula (III) or (IV):

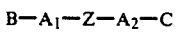

Formula (III)

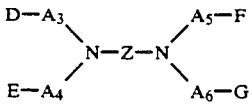

Formula (IV)

wherein $A_1$ through $A_6$ independently represent an unsubstituted or substituted alkyl group;

Z represents an alkylene group, a cycloalkylene group, a phenylene group, —R—O—R—, —RO-ROR, wherein R represents an alkyl group, or N-$A_7$, wherein $R_7$ represents a hydrogen atom, a hydrocarbon, a lower aliphatic carbonic acid or a lower alcohol; and B, C, D, E, F and G independently represent an —OH group, a —COOM group, or a —$PO_{3M2}$ group, wherein M represents a hydrogen atom, an alkali metal or an ammonium cation.

7. A method according to claim 6, wherein said hydrocarbon is a $C_1$-$C_{12}$ alkyl group and wherein said lower alcohol is a $C_1$-$C_4$ alcohol.

8. A method according to claim 4, wherein the soluble iron salt is a complex salt of an iron ion and a compound represented by Formula (V):

Formula (V)

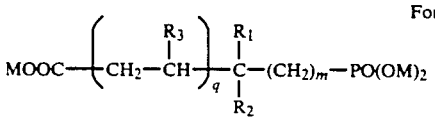

wherein $R_1$ represents —COOM or —$PO(OM)_2$;

$R_2$ represents a hydrogen atom, an alkyl group, a —$(CH_2)_n$COOM group or a phenyl group;

$R_3$ represents a hydrogen atom or —COOM;

M represents a hydrogen atom, an alkali metal, or an ammonium cation;

m and q independently represent an integer 0 or 1; and n represents an integer from 1 to 4.

9. A method according to claim 8, wherein said alkyl group is a $C_1$-$C_4$ alkyl group.

10. A method according to claim 4, wherein the soluble iron salt is a complex salt of an iron ion and a compound represented by Formula (VI):

$R_4N(CH_2PO_3M_2)_2$ Formula (VI)

wherein $R_4$ represents an alkyl group, an aryl group, an aralkyl group or a nitrogen-containing 6-membered heterocyclic group; and M represents a hydrogen atom, an alkali metal or an ammonium cation.

11. A method according to claim 10, wherein said six-membered heterocyclic group is substituted by at least one moiety selected from the group consisting of —OH, —$OR_5$, wherein $R_5$ is a $C_{1-4}$ alkyl group, —$PO_3M_2$, —$CH_2PO_3M_2$, —$N(CH_2PO_3M_2)_2$, —$COOM_2$ and —$N(CH_2COOM)_2$.

12. A method according to claim 4, wherein the soluble iron salt is a complex salt of an iron ion and a compound represented by Formula (VII):

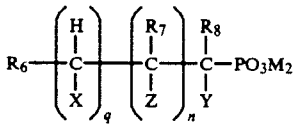

wherein $R_6$, $R_7$and $R_8$ independently represent a hydrogen atom, a lower alkyl group, —OH, a hydroxyalkyl group, $PO_3M_2$, or —$NJ_2$, wherein J represents a hydrogen atom, —OH, a lower alkyl group or —$C_2H_4OH$;

X, Y and Z independently represent —OH, —COOM, —$PO_3M_2$ or a hydrogen atom;

M represents a hydrogen atom, an alkali metal or an ammonium cation; and n and q independently represent an integer of 0 or 1.

13. A method according to claim 12, wherein both of said lower alkyl groups are $C_{1-4}$ alkyl groups.

14. A method according to claim 4, wherein the soluble iron salt is a complex salt of an iron ion and a compound represented by Formula (VIII):

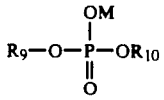

Formula (VIII)

wherein

M, $R_9$ and $R_{10}$ independently represent a hydrogen atom, an alkali metal, an ammonium cation, a $C_{1-12}$ alkyl group, an alkenyl group, or an alicyclic group.

15. A method according to claim 4, wherein the soluble iron salt is a complex salt of an iron ion and a compound represented by Formula (IX):

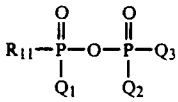

Formula (IX)

wherein $R_{11}$ represents an alkyl group, an alkoxy group, a monoalkylamino group, a dialkylamino group, an amino group, an aryloxy group, an allylamino group or an amyloxy group; and $Q_1$ through $Q_3$ independently represent —OH, an alkoxy group, an aralkyloxy group, an aryloxy group, or —$OM_3$, wherein $M_3$ represents an alkali metal or an ammonium cation, an amino group, a morpholino group, a cyclic amino group, an alkylamino group, a dialkylamino group, an allylamino group or an alkoxy group.

16. A method according to claim 15, wherein, for $R_{11}$, said alkyl group is a $C_{1-12}$ alkyl group, said alkoxy group is a $C_{1-12}$ alkoxy group, said monoalkylamino group is a $C_{1-12}$ monoalkylamino group, said dialkylamino group is a $C_{2-12}$ dialkylamino group, said aryloxy group is a $C_{1-24}$ aryloxy group and said amyloxy group is a $C_6$–$C_{24}$ amyloxy group and wherein, for $Q_1$ through $Q_3$, said alkoxy group is a $C_1$–$C_{24}$ alkoxy group.

17. A method of claim 4, wherein the concentration of the iron salt is from about $1\times10^{-4}$ to about $1\times10^{-1}$ mol/l.

18. A method of claim 4, wherein at least a portion of the soluble ion salt in the dye stabilizing solution was present in a bath during the previous processing step.

19. A method according to claim 4, wherein said stabilizing solution further comprises one or more buffering agents.

20. A method according to claim 19, wherein said buffering agents are selected from the group consisting of borate, metaborate, borax, monocarboxylate, dicarboxylate, polycarboxylate, hydroxycarboxylate, amino acid, aminocarboxylate, monobasic phosphate, dibasic phosphate, tribasic phosphate, sodium hydroxide, and potassium hydroxide.

21. A method according to claim 19, wherein said stabilizing solution further comprises one or more chelating agents.

22. A method according to claim 21, wherein said chelating agents are selected from the group consisting of aminopolycarboxylate, aminopolyphosphonic acid, phosphonocarboxylic acid, alkylidenediphosphonic acid, polyphosphate, pyrophosphoric acid, metaphosphoric acid, and gluconate.

23. A method according to claim 4, wherein said stabilizing solution further comprises one or more additives.

24. A method according to claim 23, wherein said additives are selected from the group consisting of fluorescent whitening dyes, surfactants, bactericides, antiseptics, organic sulfur compounds, onium salts, formalin, and hardening agents.

25. A method according to claim 4, wherein said stabilizing solution further comprises a fluorescent whitening dye.

26. A method according to claim 4, wherein said stabilizing solution further comprises a bactericide.

27. A method according to claim 4, wherein said stabilizing solution further comprises an organic sulfur compound.

28. A method according to claim 4, wherein said stabilizing solution further comprises aminopolyphosphonic acid or alkylidenediphosphonic acid.

29. A method according to claim 4, wherein no washing step occurs subsequent to said step of contacting said developed silver halide photographic material with said dye stabilizing solution.

30. A method according to claim 4, wherein the soluble complex salt of an iron ion concentration is from $4\times10^{-4}$ mol/l to $1\times10^{-2}$ mol/l.

31. A method according to claim 30, wherein the contact step is subsequent to a processing step in a bleach-fixing bath.

32. A method of stabilizing a light-sensitive silver halide color photographic material comprising the step of contacting in multiple stabilizing tanks subsequent to a processing step in a bleach-fixing bath or a fixing bath, a developed silver halide color photographic material with a dye stabilizing solution adjusted to a pH value between about 3 and about 9 and comprising a soluble complex salt of an iron ion, said soluble complex salt being present in the last of said multiple tanks in an amount effective to stabilize the photographic material.

33. A method according to claim 32, wherein no washing step occurs subsequent to said step of contacting said developed silver halide photographic material with said dye stabilizing solution.

34. A method according to claim 32, wherein the soluble complex salt of an iron ion concentration is from $1\times10^{-4}$ mol/l to $1\times10^{-1}$ mol/l.

35. A method according to claim 34, wherein the contact step is subsequent to a processing step in a bleach-fixing bath.

36. A method of stabilizing a light-sensitive silver halide color photographic material comprising the step of contacting subsequent to a processing step in a bleach-fixing bath or a fixing bath, a developed silver halide color photographic material at the last stage of color processing of said photographic material with a dye stabilizing solution adjusted to a pH value between about 3 and about 9 and comprising a soluble complex salt of an iron ion, said complex salt being present in the last stage of color processing in an amount effective to stabilize the photographic material.

37. A method according to claim 36, wherein the soluble complex salt is present in a concentration of at least $1\times10^{-4}$ mol/l.

38. A method according to claim 36, wherein no washing step occurs subsequent to said step of contacting said developed silver halide color photographic material with said dye stabilizing solution.

39. A method according to claim 37, wherein no washing step occurs subsequent to said step of contacting said developed silver halide color photographic material with said dye stabilizing solution.

40. A method according to claim 37, wherein the soluble complex salt of an iron ion concentration is from $1\times10^{-4}$ mol/l to $1\times10^{-1}$ mol/l.

41. A method according to claim 40, wherein the contact step is subsequent to a processing step in a bleach-fixing bath.

* * * * *